US010662707B2

(12) United States Patent
Koeman, IV

(10) Patent No.: US 10,662,707 B2
(45) Date of Patent: May 26, 2020

(54) WEDGE LADDER LEVELER

(71) Applicant: Peter Koeman, IV, Santa Cruz, CA (US)

(72) Inventor: Peter Koeman, IV, Santa Cruz, CA (US)

( * ) Notice: Subject to any disclaimer, the term of this patent is extended or adjusted under 35 U.S.C. 154(b) by 0 days.

(21) Appl. No.: 15/498,500

(22) Filed: Apr. 27, 2017

(65) Prior Publication Data

US 2018/0313152 A1 Nov. 1, 2018

(51) Int. Cl.
*E06C 7/44* (2006.01)

(52) U.S. Cl.
CPC ..... *E06C 7/44* (2013.01)

(58) Field of Classification Search
CPC ..... E04G 5/04; E04G 3/26; E04G 21/185; E04G 21/1877; E04G 5/32; E04G 5/36; E04G 5/42; E06C 7/42; E06C 7/44; E06C 7/46; E06C 7/165
USPC ..... 182/203, 121
See application file for complete search history.

(56) References Cited

U.S. PATENT DOCUMENTS 789,034 A * 5/1905 Jones ..... E04G 3/26 182/150
2,708,543 A * 5/1955 Matich ..... E06C 1/345 182/196
3,037,579 A * 6/1962 Barrow ..... E06C 1/34 182/107
3,067,836 A * 12/1962 Carnicelli ..... E06C 7/16 182/121
3,339,920 A * 9/1967 Moritz ..... A63B 9/00 182/181.1
3,390,739 A * 7/1968 Hastings ..... E06C 7/44 182/108
3,993,275 A * 11/1976 Lucas ..... E06C 7/426 248/188.2
4,100,998 A * 7/1978 Marquez ..... E06C 7/16 182/116
4,368,555 A * 1/1983 Salerno ..... E05F 5/003 16/83
4,450,935 A * 5/1984 Gustavus ..... E04G 3/26 182/45
4,469,194 A * 9/1984 McBride ..... E06C 7/48 182/107
4,695,023 A * 9/1987 McCafferty ..... E06C 1/345 182/121
4,699,247 A * 10/1987 Clarke ..... E06C 7/426 182/107
4,770,272 A * 9/1988 Riley ..... E04D 15/00 182/106
4,776,548 A * 10/1988 Bezenek ..... B60T 3/00 248/188.2

(Continued)

*Primary Examiner* — Daniel P Cahn
(74) *Attorney, Agent, or Firm* — Patrick Reilly

(57) ABSTRACT

A ladder placement leveling device is easily stored for transport and used by firefighters to quickly and effectively level a fire service ladder put in service on uneven ground. The device is mounted for transport and storage to a ladder and does not impede use of an attached ladder when the device is attached to the ladder a storage positioned. The device includes a wedge, a strap and an assembly for attaching and looping the strap around a ladder rung. One element of the assembly forms a detachable attachment to the wedge. The assembly attaches to the wedge at each end of the detachably formed strap loop.

22 Claims, 5 Drawing Sheets

(56) References Cited

U.S. PATENT DOCUMENTS 4,830,320 A * 5/1989 Bellows ..... A47B 91/12 248/188.2
4,880,079 A * 11/1989 Leclerc ..... E06C 7/48 182/107
4,917,219 A * 4/1990 Henry ..... B60T 3/00 188/32
4,987,720 A * 1/1991 Wozney, Jr. ..... E04D 15/02 248/237
5,058,789 A * 10/1991 Piper ..... B65G 7/12 224/265
5,099,952 A * 3/1992 Farrell ..... E06C 7/16 182/122
5,139,109 A * 8/1992 Clarke ..... E06C 7/44 182/108
5,148,891 A * 9/1992 McConnell ..... E06C 7/14 182/120
5,203,845 A * 4/1993 Moore ..... G06F 3/0395 248/118
5,207,364 A * 5/1993 Johnson ..... B65G 7/12 224/264
5,232,187 A * 8/1993 O'Farrell ..... E04F 21/00 248/148
5,249,397 A * 10/1993 Monaco ..... E04G 3/26 182/45
5,249,767 A * 10/1993 Mellen ..... F16M 7/00 248/188.2
5,263,551 A * 11/1993 Andersen ..... B25H 1/06 182/107
5,339,921 A * 8/1994 Faupel ..... E04D 15/00 182/111
5,465,809 A * 11/1995 Panicci ..... E06C 7/16 182/121
5,484,036 A * 1/1996 Cothern ..... E06C 1/34 182/107
5,664,641 A * 9/1997 Ritze ..... E04D 13/12 182/45
5,791,438 A * 8/1998 Kempton ..... E06C 7/426 182/200
5,842,746 A * 12/1998 Rogers ..... A47C 27/008 297/463.2
5,845,740 A * 12/1998 Bouwkamp ..... A62B 1/04 182/45
5,862,881 A * 1/1999 O'Brien ..... E04G 1/30 182/117
5,887,406 A * 3/1999 Bond ..... E04D 15/00 182/45
5,934,627 A * 8/1999 Lewis ..... E04D 15/00 248/148
6,164,608 A * 12/2000 Schiel, Jr. ..... E06C 7/44 182/200
6,170,222 B1 * 1/2001 Miller ..... E04D 1/26 248/237
6,193,012 B1 * 2/2001 Olivas ..... A45C 13/30 182/129
6,490,842 B2 * 12/2002 Emmons ..... E04D 15/00 182/45
6,513,625 B1 * 2/2003 Gaskins ..... E04D 15/00 182/107
6,616,128 B2 * 9/2003 Selzer ..... A62B 3/005 254/104
6,793,041 B1 * 9/2004 Taylor ..... E06C 7/44 182/121
7,104,524 B1 * 9/2006 Hidding ..... B66F 7/243 14/69.5
7,849,963 B1 * 12/2010 D'Agostino ..... A45F 3/14 182/129
8,104,575 B1 * 1/2012 Bancroft ..... E01C 9/086 182/45
8,448,746 B2 * 5/2013 Davis, Jr. ..... E04D 15/00 182/45
8,727,074 B1 * 5/2014 Bhajan ..... E06C 7/165 182/119
8,739,941 B2 * 6/2014 White ..... B60P 3/36 14/69.5
8,783,415 B2 * 7/2014 Bancroft ..... E06C 7/48 182/107
D712,726 S * 9/2014 Perrin ..... D8/374
8,935,822 B2 * 1/2015 Frederiksen ..... E01D 19/06 14/69.5
9,016,433 B1 * 4/2015 Duffy ..... E04G 3/26 182/45
9,145,687 B1 * 9/2015 Bancroft ..... E06C 1/10
9,273,515 B2 * 3/2016 O'Grady, Sr. ..... E04G 3/265
D752,959 S * 4/2016 Perrin ..... D8/374
9,587,408 B1 * 3/2017 Brannon ..... E04G 3/22
2002/0027091 A1 * 3/2002 Brown ..... B25H 3/06 206/372
2002/0046543 A1 * 4/2002 Neuleib ..... E04D 15/00 52/749.12
2002/0153200 A1 * 10/2002 Bryant ..... E04G 3/26 182/45
2003/0037990 A1 * 2/2003 Testa, Jr. ..... E04D 15/00 182/45
2003/0047574 A1 * 3/2003 Horneman ..... A45F 3/12 224/264
2003/0230451 A1 * 12/2003 Garrett ..... B23D 45/003 182/45
2005/0132511 A1 * 6/2005 Berg ..... B66F 7/243 14/69.5
2005/0173190 A1 * 8/2005 Garrett ..... B23D 45/003 182/45
2006/0226310 A1 * 10/2006 Hall ..... B44D 3/14 248/148
2006/0277863 A1 * 12/2006 Henning, Sr. ..... E04D 15/00 52/749.12
2007/0272485 A1 * 11/2007 Baake ..... A62B 35/0068 182/45
2007/0284190 A1 * 12/2007 Chady ..... E06C 7/46 182/107
2010/0288583 A1 * 11/2010 Becker ..... E04G 3/24 182/128
2010/0307869 A1 * 12/2010 Hazuka, II ..... E04G 3/26 182/141
2011/0011676 A1 * 1/2011 DeLair ..... E06C 1/345 182/129
2011/0226551 A1 * 9/2011 Iverson ..... E06C 7/44 182/107
2011/0247895 A1 * 10/2011 Smith ..... E06C 7/165 182/106
2012/0199416 A1 * 8/2012 Hopkins ..... E06C 7/42 182/111
2012/0241251 A1 * 9/2012 Painter ..... E04G 3/26 182/45
2012/0266436 A1 * 10/2012 Rittmann ..... E06C 7/14 29/428
2013/0037349 A1 * 2/2013 Vaidyaselvan ..... E06C 7/46 182/107
2014/0209411 A1 * 7/2014 McCarthy ..... E06C 1/345 182/129
2014/0291072 A1 * 10/2014 Kurzer ..... E06C 7/44 182/111
2015/0041251 A1 * 2/2015 Hudson ..... E04G 3/26 182/45
2015/0225969 A1 * 8/2015 O'Grady, Sr. ..... E04G 3/265 182/45
2015/0289649 A1 * 10/2015 Perrin ..... A47B 91/12 248/346.06
2016/0160514 A1 * 6/2016 Ashman ..... E04G 3/26 182/130

* cited by examiner 21
22
24
20
25
29
20
28
28
23
34
27
33
26

WEDGE LADDER LEVELER

BACKGROUND OF THE INVENTION

The present invention is designed to enable a user to level prior art straight and extension ladders placed into service on uneven ground. In certain applications, such as fire fighting, where time is of the essence, to include a real world fire ground environment where speed and efficiency are the most important factors to successful adder deployment, there is a long felt need for improved devices and methods for providing a stable positioning of a ladder on uneven ground.

Standard practice according to the International Fire Service Training Association advises that no ground ladder should be ascended without being reliably and stably supported from the ground; the method of the present invention addresses this object. The present invention takes a very simple shape adapted to the objective of leveling a ladder that has been placed into service on uneven ground.

There is currently no standard practice for leveling a ladder in the fire ground scenario, other than to pull the ladder towards the objective until both beams of the ladder touch firm ground surface. This prior art technique often places undo twisting stress on the ladder and applies forces to ladder beams that these ladders are not tested for.

While there are other leveling options on the market (e.g. U.S. Pat. Nos. 4,423,797, 6,336,521 & 5,542,497) these require permanent modifications to ladder, bulky add ons that are not conducive to how ladders are stored on fire department apparatus. These are quality products designed for the single craftsman who has the opportunity and ability to take the time to securely and stably position a ladder without haste.

BRIEF SUMMARY OF THE INVENTION

The primary object of the method of the present invention is to provide an operator with a wedge ladder leveler that provides superior performance over prior art devices.

Another object of the method of the present invention present invention is to provide a wedge ladder leveler that can be placed into service with one hand, which allows the user or users to maintain control of a ladder while using the present invention to level said ladder.

An additional object of the method of the present invention present invention is to provide a wedge ladder leveler that can be attached to a prior art ladder without any permanent modifications to said ladder.

A further object of the method of the present invention present invention is to provide a wedge ladder leveler that can be stored on a prior art ladder in a ready to operate position without impeding use if the ladder is placed in service and the wedge ladder leveler is not needed.

Another object of the method of the present invention present invention is to provide a wedge ladder leveler that fits inside the footprint or original space of a prior art ladder, thus allowing the user to continue to store the prior art ladder in the original storage configuration.

Another object of the method of the present invention present invention is to provide a wedge ladder leveler that is designed with speed of operation when used in a fire ground environment where two or more persons are operating a prior art ladder as a trained team.

Another object of the method of the present invention present invention is to provide a wedge ladder leveler that is relatively simple to construct relative to the prior art thus keeping costs to an affordable amount.

DETAILED DESCRIPTION OF THE INVENTION

Figures 1, 2:
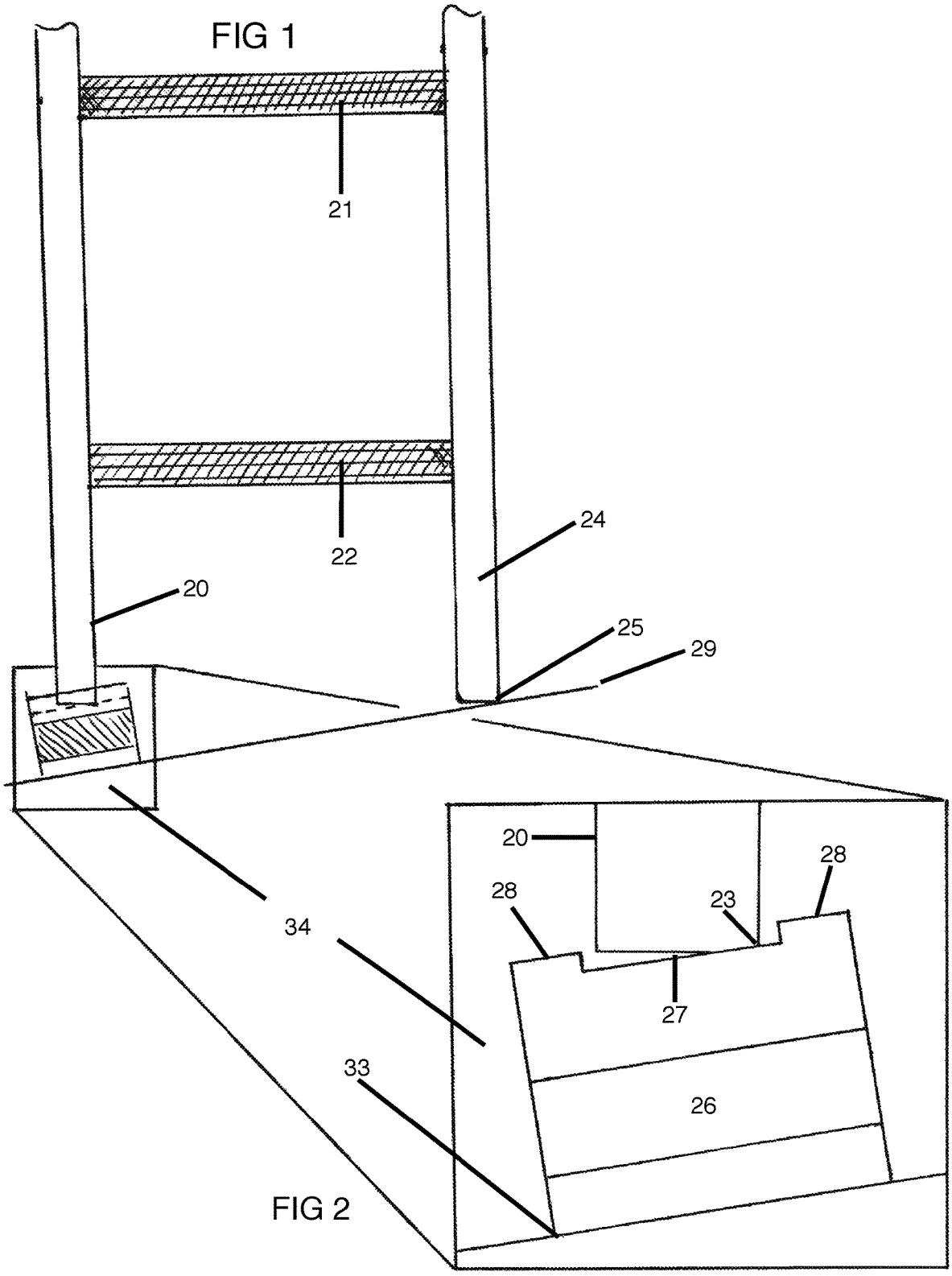
FIG. 1 is a overall perspective from users point of view as if the left beam of a prior art ladder (hereinafter, the ladder") was needing support from the invented wedge ladder leveler which is underneath the left side beam of ladder.
FIG. 2 is a close up view of the invented wedge ladder leveler of FIG. 1 to provide more detail.
Figure 3:
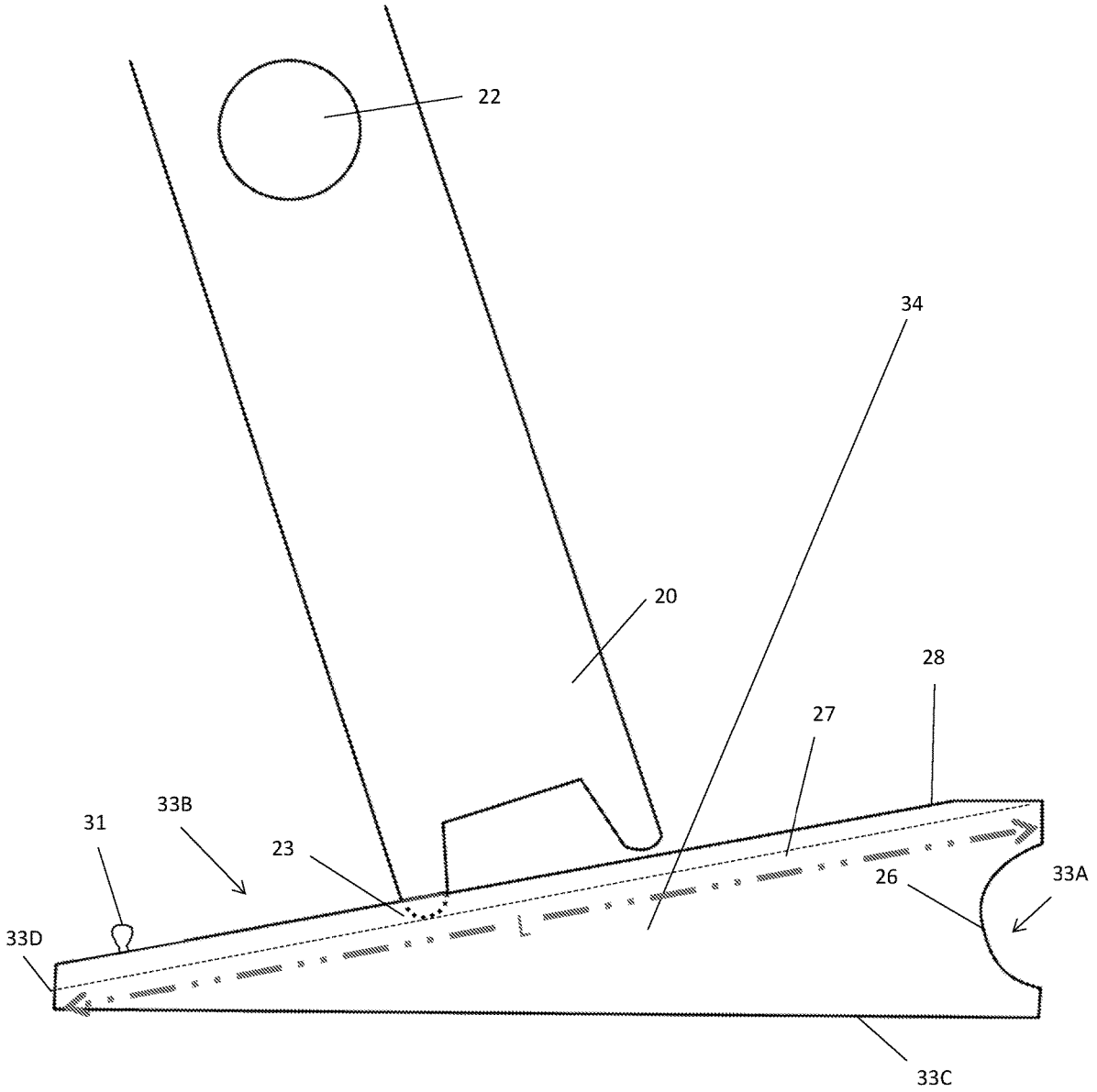
FIG. 3 is side view of a ladder foot resting on the invented wedge ladder leveler of FIG. 1 and shows that the foot of the ladder sits in a groove on top of the invented wedge ladder leveler of FIG. 1 that stabilizes the ladder from lateral movement off the invented wedge ladder leveler of FIG. 1.
Figure 4:
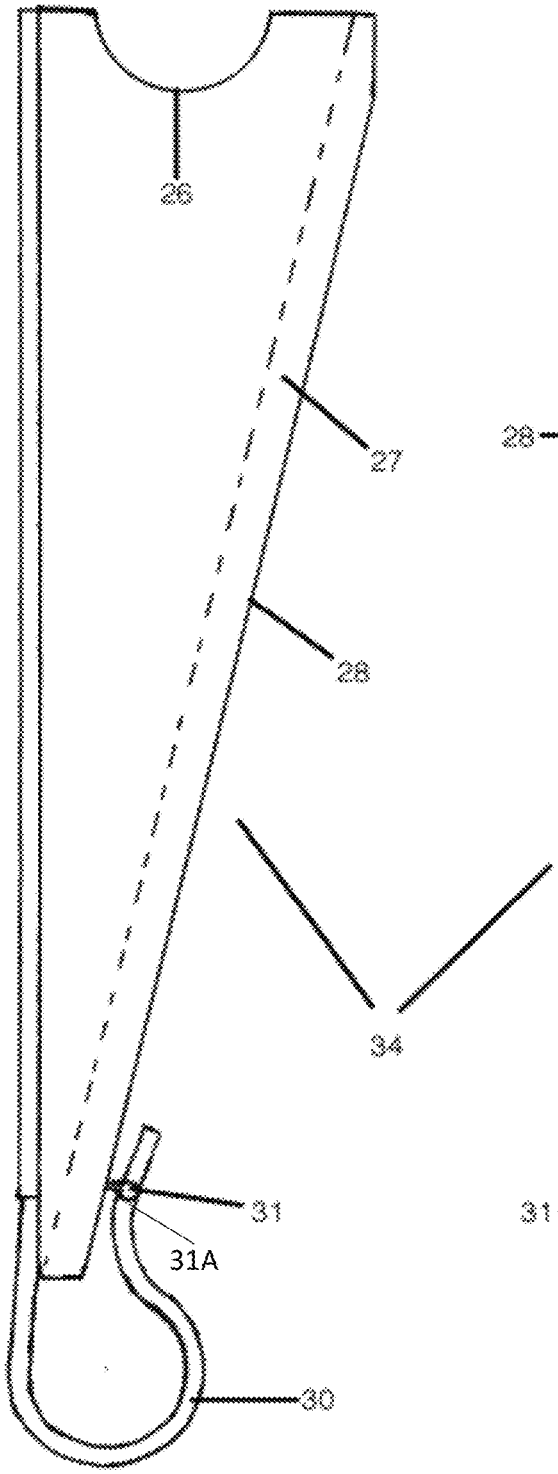
FIG. 4 is a side view of the invented wedge ladder leveler of FIG. 1 that provides detail seen in other drawings but also includes a strap that wraps around an upper ladder rung in one alternate mounting configuration.
Figure 5:
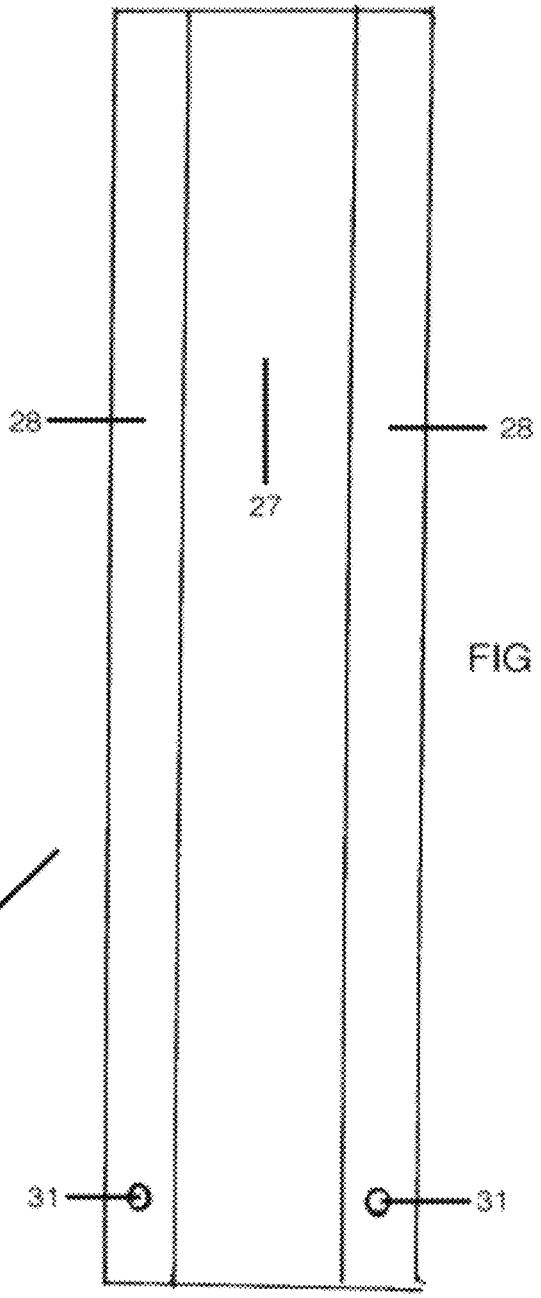
FIG. 5 is top view of the invented wedge ladder leveler of FIG. 1 that shows an optional center cut groove and optional top strap anchors.
Figure 6:
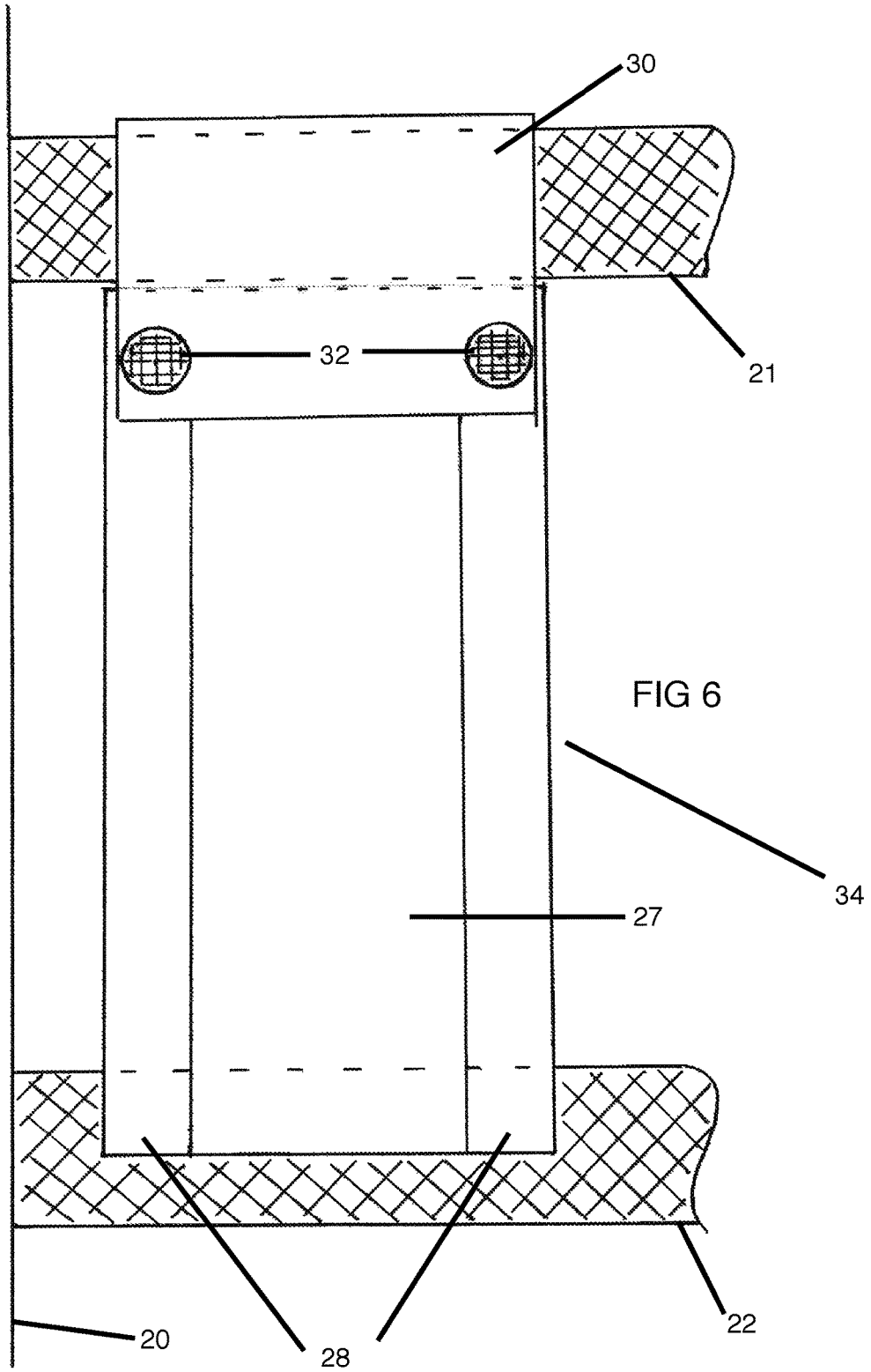
FIG. 6 shows the front view of the invented wedge ladder leveler of FIG. 1 stored in-between two rungs of the prior art ladder of FIG. 1.
Figure 7:
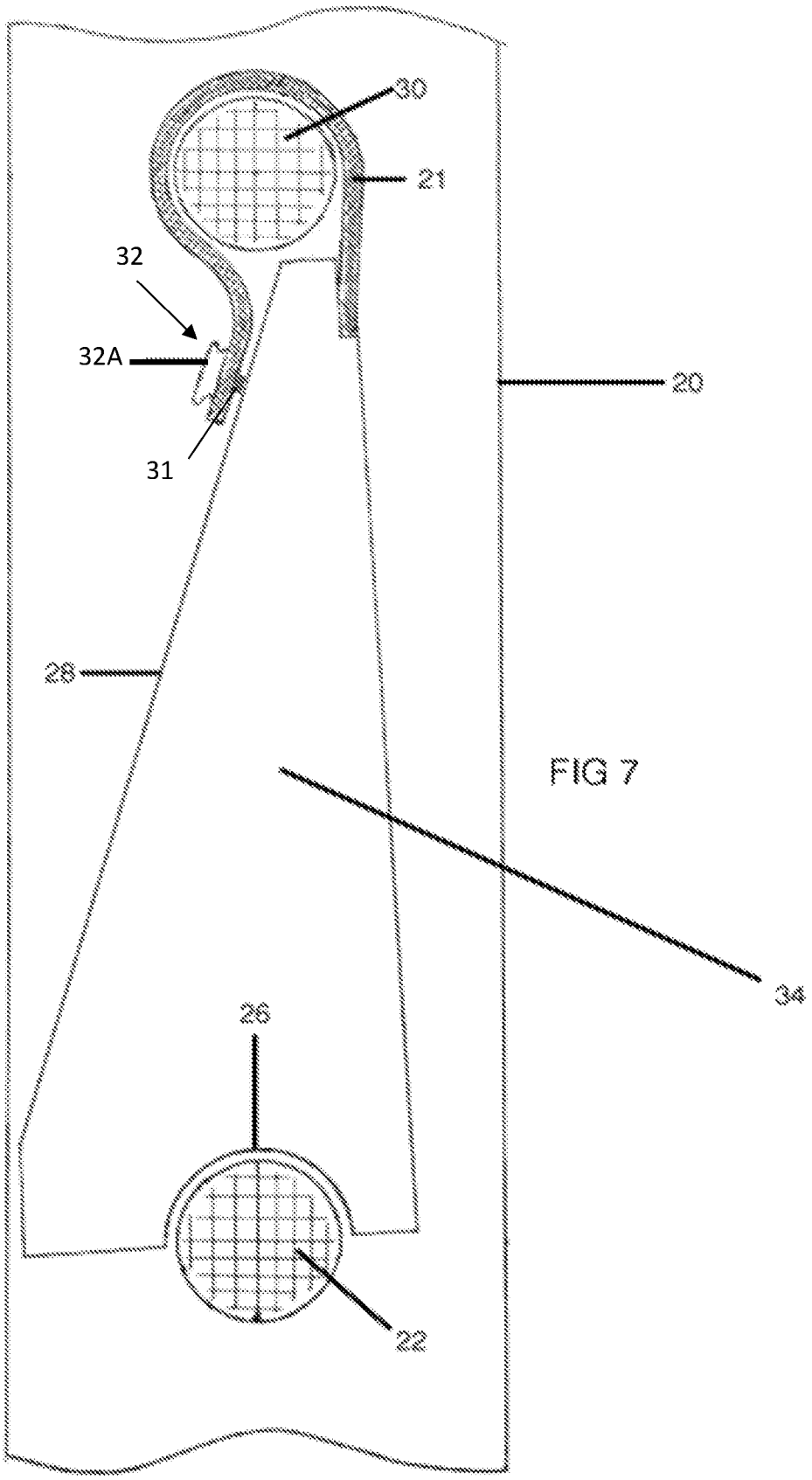
FIG. 7 is a side cut away view that shows the invented wedge ladder leveler of FIG. 1 stored on the prior art ladder of FIG. 1 in-between two prior art ladder rungs.

Turning now descriptively to the drawings in which similar reference characters denote similar elements throughout the five sheets of drawings. FIG. 1 through 3 show an invented wedge ladder leveler 34 in normal operation. FIGS. 4 and 5 show stand alone side and top views of the invented wedge ladder leveler 34 and include the drawing of an integrated strap 33 that helps store the invented wedge ladder leveler 34 when not in use. FIGS. 6 and 7 show the invented wedge ladder leveler 34 stored on a prior art ladder 24 between two rungs 21 & 22 with a front and a cut way side view.

FIG. 1 through 3 show the invented wedge ladder leveler 34 comprising a wedge comprising a milled piece of high density polyurethane 13.125" long, 3.25" wide and 3.125" tall. The invented wedge ladder leveler 34 has design features including a 1.25" diameter half circle cut out 26 that allows it to rest on a rung 21 & 22 in normal stored position. A full length 1.5" wide, 0.375" deep groove 27 cut down the top center of the invented wedge ladder leveler 34 to keep foot of the prior art ladder 24 from lateral movement off the device.

FIG. 4 shows a side view of the wedge ladder leveler 34, including the planar center groove 27 and the radius cut-out 26 of the bottom side 33A and with the integrated rung strap 30 that attaches to the strap anchors 31 that are attached to the upper rails 28 of the invented wedge ladder leveler 34. The strap 30 includes at least one anchor aperture 31A. FIG. 5 is top view with different perspective of same characteristics. Planar center groove 27 is designed so any of the two most common manufactures fire service prior art ladders feet 25 can fit with minimal clearance to ensure stability.

FIG. 6 shows a front view of the wedge ladder leveler 34 in stored position on the prior art ladder 24 between upper rung 21 and lower rung 22. In the drawing the invented wedge ladder leveler 34 is shown mounted away from the ladder beam 20 just to show differentiation. With the preferred width of the invented wedge ladder leveler 34 the method of the present invention enables and allows the U.S. Federal Occupational Health and Safety approved space between rungs 21 & 22 while the invented wedge ladder leveler 34 is attached to the prior art ladder 24. FIG. 6 also illustrates the integrated top rung strap 30, with marine grade stainless steel quick release snap assemblies 32 attached to the strap anchor studs 31 mounted to upper rails 28 of the invented wedge ladder leveler 34.

FIG. 7 is a side view cut away of the wedge ladder leveler 34 mounted in FIG. 6. FIG. 7 shows a strap snap 32A from a quick release snap assembly 32 as attached to an anchor 31. The same characteristics and design elements remain as in FIG. 6 with the illustration of how the invented wedge ladder leveler 34 remains inside the volume or footprint of the prior art ladder 24. As was stated already, this was designed primarily for the fire service due to the fact that, it is my field of expertise. Ladder storage on fire apparatus allows for minimal clearance to keep prior art ladders 24 from moving too much in their brackets. The wedge ladder leveler's 34 ability to be attached to the prior art ladder 24 and be detachable and used when desired or needed is one key benefit of the method of the present invention.

The operation of the invented wedge ladder leveler 34 is based on simplicity and speed. When placing the prior art ladder 24 against an object on uneven ground a user would secure the prior art ladder 24 against the object with one hand and release the wedge ladder leveler 34 with the other hand. The user would then slide the invented wedge ladder leveler 34 under the ladder foot of the prior art ladder 24 that needed support until the wedge touched the prior art ladder 24 giving support off the firm surface that the other foot of the prior art ladder 24 rests on.

There are numerous designs for ladder levelers but they do not include the speed capabilities of the invented wedge ladder leveler 34. The other prior art items on the market are designed for a single craftsman to place into service and used for extended amounts of time. The method of the present invention relies on the standard operating principles of fire departments all over the country and that dictate that two or more personnel should operate a ground ladder when placed into service. The method of the present invention places a bigger safety factor on the extra firefighter using a prior art ladder 24, supported by the invented wedge ladder leveler 34 and provides tremendous reduction of speed of deployment.

To produce the wedge ladder leveler 34 one may apply an 18" wedge of 3.5"×3.5" douglas fir that has been milled down to the specifications disclosed in the FIGS. 1 through 7 and accompanying text. The wedge may alternatively comprise high density polyurethane. The integrated top rung strap 30 may comprise high quality leather with stainless steel hardware to add durability.

The claimed invention is:

1. A device comprising:

a ladder having at least a first ladder rung and a second ladder rung;

a body comprising a top side, a ground side, a ladder side, and a bottom side;

the ground side extending from the top side, the ground side forming a substantially planar ground surface;

the ladder side extending from the top side, the ladder side forming a substantially planar ladder surface, and the ladder surface oriented at an acute angle in relation to the ground surface proximate to the top side;

the bottom side positioned distally from the top side and between the ground side and the ladder side;

a strap assembly having a strap having a fixed end and a detaching end, and the strap presenting a length extending between the fixed end and the detaching end that enables the strap assembly in combination with the top side to encircle the first ladder rung, wherein the fixed end is attached to the ground side proximate to the top side and the detaching end is detachably attachable to the ladder side proximate to the top side;

a snap assembly for detachably attaching the detaching end of the strap to the ladder side comprising a strap snap and a body snap, the strap snap attached to the strap detaching end and the body snap attached to the ladder side of the body proximate to the top side, wherein the strap snap and the body snap are adapted to detachably couple; and a semi-circular cut-out formed in the bottom side, the cut-out shaped to fit around the second ladder rung.

2. The device of claim 1 wherein the snap assembly further comprises a second strap snap and a second body snap, the second strap snap attached to the strap detaching end and the second body snap attached to the ladder side of the body proximate to the top side, wherein the second strap snap and the second body snap are adapted to detachably couple.

3. The device of claim 1, wherein the strap is sized, shaped and positioned to wrap around the first ladder rung while the cut-out is positioned around the second ladder rung.

4. The device of claim 2, wherein the strap is permanently attached to the ground side.

5. The device of claim 2, wherein the strap is detachably coupled to the ladder side.

6. The device of claim 1, wherein an inner arc of the cut-out is less than semi-circular.

7. The device of claim 1, wherein the ground side is planar.

8. The device of claim 1, wherein the ladder side is planar.

9. The device of claim 8, wherein the ground side is planar.

10. The device of claim 1, wherein the ladder surface forms a groove extending in depth toward the ground side.

11. The device of claim 1, wherein a groove extends along an entire elongate length of the ladder side.

12. The device of claim 1, wherein a groove of the ladder side extends toward the top side and is oriented at an acute angle in relation to the ground side at the top side.

13. The device of claim 12, wherein the groove is planar.

14. The device of claim 12, wherein an inner arc of the cut-out is less than semi-circular.

15. The device of claim 12, wherein the ground side is planar.

16. The device of claim 12, wherein the groove is planar.

17. The device of claim 16, wherein the ground side is planar.

18. The device of claim 1, wherein the acute angle formed between the ladder side and the ground side is less than 45 degrees.

19. The device of claim 1, wherein the acute angle formed between the ladder side and the ground side is less than 30 degrees.

20. A device comprising:

a ladder having at least a first ladder rung and a second ladder rung;

a body comprising a top side, a ground side, a ladder side, and a bottom side;

the ground side extending from the top side, the ground side forming a substantially planar ground surface;

the ladder side extending from the top side, the ladder side forming a substantially planar ladder surface, and the ladder surface oriented at an acute angle in relation to the ground surface proximate to the top side;

the bottom side positioned distally from the top side and between the ground side and the ladder side;

a strap assembly having a strap having a fixed end and a detaching end, and the strap presenting a length extending between the fixed end and the detaching end that enables the strap assembly in combination with the top side to encircle the first ladder rung, wherein the fixed end is attached to the top side and the detaching end has a first aperture extending through the strap;

an anchor fixedly attached to and extending away from the ladder side, the anchor sized to extend through the first aperture and the anchor shaped to detachably couple the strap with the body; and a semi-circular cut-out formed in the bottom side, the cut-out shaped to fit around the second ladder rung.

21. The device of claim 20, further comprising:

a second aperture extending through the strap at the detaching end; and a second anchor fixedly attached to and extending away from the ladder side, the second anchor sized to extend through the second aperture and the second anchor shaped to detachably couple the strap with the body.

22. A device comprising:

a ladder having at least a first ladder rung and a second ladder rung;

a body comprising a top side, a ground side, a ladder side, and a bottom side;

the ground side extending from the top side, the ground side forming a substantially planar ground surface;

the ladder side extending from the top side, the ladder side forming a substantially planar ladder surface, and the ladder surface oriented at an acute angle in relation to the ground surface proximate to the top side;

the bottom side positioned distally from the top side and between the ground side and the ladder side;

a strap having a fixed end and a detaching end, and the strap presenting a length extending between the fixed end and the detaching end that enables the strap in combination with the body top side to encircle the first ladder rung, wherein the fixed end is attached to the ground side proximate to the top side and the detaching end is detachably attachable to the ladder side proximate to the top side;

a detachable coupling assembly comprising a strap element attached to the strap detaching end and a body element attached to the body, wherein the strap element and the body element are detachably attached while the strap and body top side in combination encircle the first ladder rung; and a semi-circular cut-out formed in the bottom side, the cut-out shaped to fit around the second ladder rung.

* * * * *